US007039960B2

(12) United States Patent
Pagani

(10) Patent No.: US 7,039,960 B2
(45) Date of Patent: May 9, 2006

(54) MULTIPLE LIQUID ACTIVE SUBSTANCE DISPENSER FOR W.C. BOWL

(75) Inventor: Fabio Pagani, Gazoldo Degli Ippoliti (IT)

(73) Assignee: RE. LE. VI. -S.p.A., Rodigo (IT)

( * ) Notice: Subject to any disclaimer, the term of this patent is extended or adjusted under 35 U.S.C. 154(b) by 0 days.

(21) Appl. No.: 10/528,158

(22) PCT Filed: Dec. 23, 2003

(86) PCT No.: PCT/EP03/14888

§ 371 (c)(1),
(2), (4) Date: Mar. 17, 2005

(87) PCT Pub. No.: WO2004/072390

PCT Pub. Date: Aug. 26, 2004

(65) Prior Publication Data

US 2006/0005308 A1 Jan. 12, 2006

(30) Foreign Application Priority Data

Feb. 17, 2003 (IT) ..... RE2003A0016

(51) Int. Cl.
*E03D 9/02* (2006.01)

(52) U.S. Cl. ..... 4/231

(58) Field of Classification Search ..... 4/222, 4/223, 227.1–227.7, 231
See application file for complete search history.

(56) References Cited

U.S. PATENT DOCUMENTS

2002/0148036 A1 10/2002 Wilson et al.
2004/0068782 A1 4/2004 Butter-Jentsch et al.

FOREIGN PATENT DOCUMENTS

| | | | |
|---|---|---|---|
| DE | 10113036 | A1 | 6/2002 |
| WO | WO 02/40787 | A1 | 5/2002 |
| WO | WO 02/40792 | A1 | 5/2002 |
| WO | WO 03048466 | A1 | 6/2003 |
| WO | WO 03/080245 | A1 | 7/2003 |

*Primary Examiner*—Tuan Nguyen
(74) *Attorney, Agent, or Firm*—Browdy and Neimark, PLLC

(57) ABSTRACT

The dispenser comprises at least two bottles (11) having separate internal chambers, each for containing an active substance (R) in the liquid state and having an exit mouth (12) for the active substance (R), and a support means (20) for supporting said bottles (11) in an inverted position, with their mouth (12) facing downwards, in a position subjected to the action of the flushing water flow, said bottles (11) being separate from the support means (20). the support means (20) comprises, for containing the active substance, at least two reservoirs (21) located in a position subjected to the action of the flushing water flow and arranged to receive the mouth (12) of the bottle, and a like number of closure members (30), each positioned in said containing reservoir (21) to each close the mouth (12) of the respective bottle (11); there is also provided for the active substance at least one passage means (35, 36) associated with each closure member (30) to enable the active substance to pass from the internal chamber of the bottle (11) to the containing reservoir (21). Each containing reservoir (21) has a side wall (21*b*) defining a volume for containing a quantity of active substance which closes said passage means (35, 36) for the active substance, the side walls (21*b*) of the reservoirs being joined together by a common corridor (29) which connects them together.

7 Claims, 6 Drawing Sheets

MULTIPLE LIQUID ACTIVE SUBSTANCE DISPENSER FOR W.C. BOWL

TECHNICAL FIELD

The present invention relates to a multiple liquid substance dispenser for a W.C. bowl, to be housed within the W.C. bowl itself.

Liquid active substance dispensers to be housed within the W.C. bowl are known, comprising a bottle for containing active substance in the liquid state, and having an exit mouth for the active substance and a support means for supporting said bottle in an inverted position with its mouth facing downwards, in a position subjected to the action of the flushing water flow.

BACKGROUND ART

A dispenser which has given excellent results is that of the present Applicant described and protected in international patent application PCT/EP 02/11765. This dispenser has a support means comprising, for containing the active substance, a reservoir located in a position subjected to the action of the flushing water flow and arranged to receive the mouth of the bottle and, foreclosing the mouth of the bottle, a closure member positioned in said containing reservoir and with which there is associated at least one passage means for the active substance to enable the active substance to pass from the internal chamber of the bottle to the containing reservoir; said containing reservoir defines a volume for containing a quantity of active substance which closes said passage means for the active substance. The containing reservoir has an upwardly facing concavity arranged to contain a determined level of liquid, and to contain the bottle exit mouth with its lower passage cross-section positioned below the maximum level of the liquid present in the reservoir.

For each flush, the flushing water penetrates into the containing reservoir and carries away a small quantity of the active substance contained in the reservoir, to dilute it and release its deodorant/cleansing/refreshing/disinfectant action. When a part of the active substance is carried away, this, probably together with the turbulence produced by the flush, causes a little ventilation air to enter the bottle, to cause a gauged descent of the active substance, corresponding to one measure, with consequent restoration of the level in the reservoir.

This type of dispenser has been shown to have a relatively long life, with a behaviour which is constant both with time and for different shapes of the W.C. reservoir; moreover the active substance contained in the bottle maintains its active characteristics (deodorant/cleansing/refreshing/disinfectant and the like) constant or nearly constant with time, for a relatively large number of flushes (up to 250–450 flushes with 50–55 ml of active substance), and does not mix with the water other than to a relatively small extent and only at the end of its life.

Dispensers are also known having a single support for supporting two bottles in an inverted position, with their mouth facing downwards in a position subjected to the action of the flushing water flow, these bottles being separate from the support means and having separate internal chambers, each or containing an active substance in the liquid state. Examples of these dispensers are illustrated in the documents WO-A-02/40792 and WO-A-02/40787. An advantage of these dispensers is that substances which cannot be combined with each other can be used at the same time, as is the case if in addition to a purifying and perfuming substance, a substance for preventing lime scale formation and/or a bleaching solution are also to be used, these latter being often non-combinable with the former.

It has been found that if the dispenser of patent application PCT/EP 02/11765 is modified to comprise two (or more) mutually independent bottles and a like number of containing reservoirs for the active substance, located in positions subject to the action of the flushing water flow to receive the mouth of a respective bottle, the dispenser when in use manifests a considerable and virtually unacceptable difference in its behaviour and in particular in the consumption of the two liquids, so that one empties before the other.

DISCLOSURE OF THE INVENTION

An object of the present invention is to provide a dispenser which when in use is able to maintain the advantageous behaviour of the dispenser of patent application PCT/EP 02/11765, while also possessing at least two mutually independent bottles which present a substantially equal behaviour one to the other and in particular which empty substantially at the same time.

This and other objects are attained by the invention as characterised in the claims.

BRIEF DESCRIPTION OF THE DRAWINGS

The invention is described in detail hereinafter with the aid of the accompanying drawings which illustrate one embodiment thereof by way of non-exclusive example.

Figure 1:
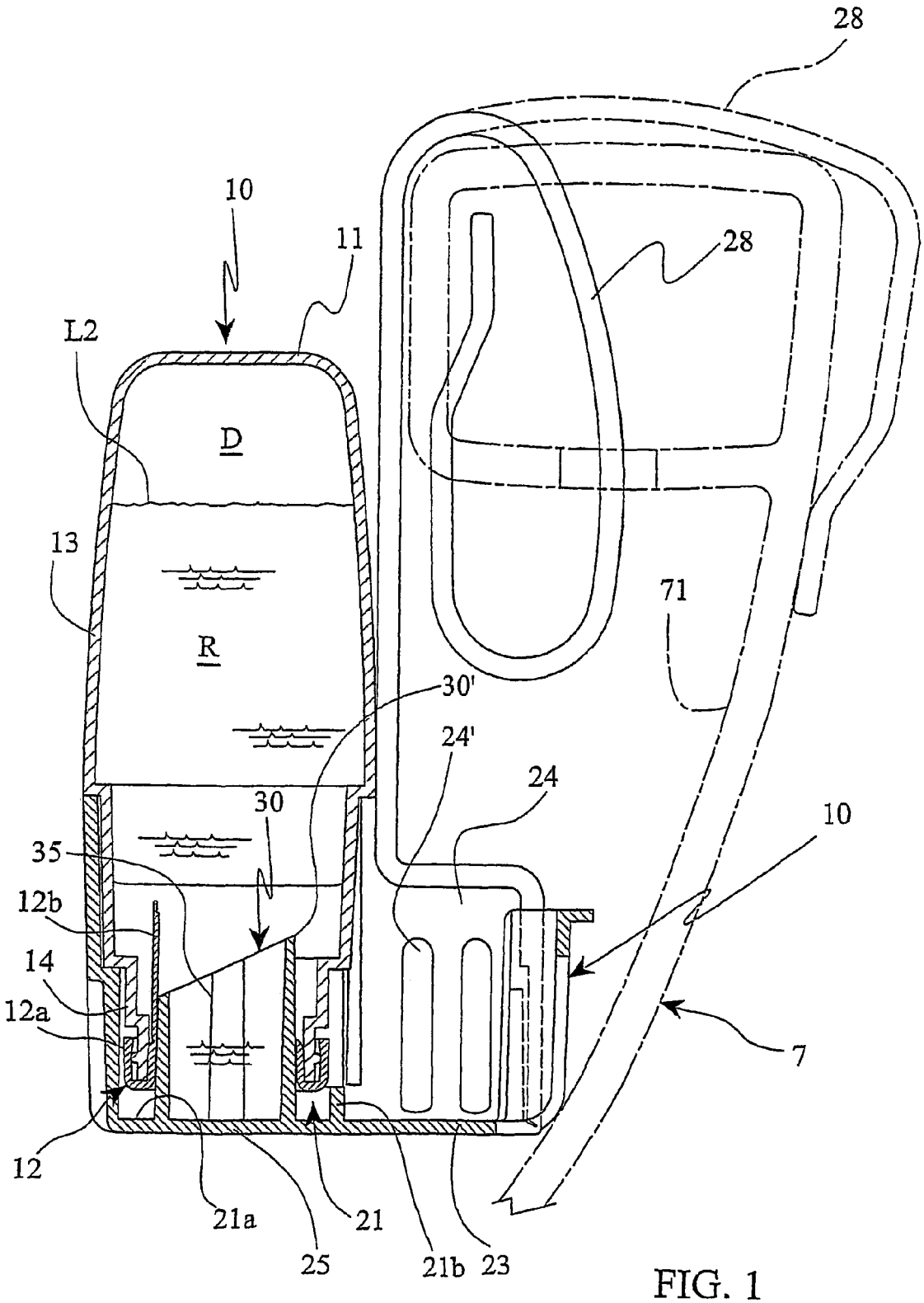
FIG. 1 is a section through the entire dispenser, taken on the plane I—I of FIG. 2.

With reference to the figures, the dispenser of the invention (indicated overall by 10) comprises two bottles 11 having separate internal chambers, each arranged to contain a respective active substance R in the (more or less viscous) liquid state, for example a deodorant substance and another substance for cleaning/disinfecting; each bottle has an exit mouth 12 for the active substance R.

The dispenser 10 also comprises a support means 20, having a usual hooking means 28, in the form of a hook-shaped elongate element of elastically flexible material, by which it is hooked to the upper rim 8 of a W.C. bowl 7; the support means 20 is able to support said bottles 11 in an inverted position with their axis substantially or nearly vertical, and their mouth 12 facing downwards, in a position subjected to the action of the flushing water flow.

Both bottles 11 are separate from the support means 20 and are associated with it in order to be located in the W.C. bowl.

The entire dispenser 10, including the bottles 11, is to be housed within the W.C. bowl 7 against its inner surface 71, below its upper rim 8, under the action of the flushing water flow. Usually, the flushing water emerges either along the rim 8 from holes provided in its lower part or, in other cases, is made to emerge from a rear central mouth of the bowl and made to flow in a tangential direction along the inner surface 71, below the rim 8. The support means 20 comprises, for containing the active substance, two reservoirs 21 with an upwardly facing concavity located in a position subjected to the action of the flushing water flow and arranged to receive the mouth 12 of the bottle, and further comprises other members 30 positioned in said containing reservoirs 21 to close the mouth of the respective bottle 11.

Each containing reservoir 21 comprises a lower wall 25 having a closed surface 21*a*, and a side wall 21*b* disposed about the mouth 12 of the bottle to define a volume for containing a quantity of substance.

Preferably, as shown in the figures, each closure member 30 is in the form of an upwardly facing, substantially cylindrical or slightly frusto-conical tube piece coaxial with the bottle 11, the exit mouth 12 of the bottle being in geometrical relationship with the tube piece 30 such that its inner surface sealedly embraces the lateral surface of the tube piece 3. The lower end of the tube piece 30 is joined to the collection surface 21*a* of the containing reservoir 21 and is closed thereby, whereas the upper end 30' projects upwards beyond the exit mouth 12 of the respective bottle when this is associated with the support means 20. Alternatively the upper end of the tube piece 30 can be closed.

With each closure member 30 there is associated at least one passage means 35 enabling the active substance R to pass from the internal chamber of the bottle 11 to the containing reservoir 21, the quantity of active substance collected by this latter being such as to close said passage means 35.

In the embodiment shown in the figures, said active substance passage means 35 is defined by a gauged vertical corridor formed by an arched recess provided in the cross-section of the lateral surface of the tube piece 30, which starts from a point within the internal chamber of the bottle 11 and terminates below the exit mouth 12; in particular, said passage means 35 extends for the entire height of the tube 30 piece.

Preferably, each bottle 11 is provide with at least one ventilation passage means 32 which, when in use, connects the internal chamber of the bottle 11 to atmospheric air.

In the embodiment shown in the figures, the ventilation passage means 31 is defined by a gauged vertical corridor formed by an arched recess provided in the cross-section of the lateral surface of the tube piece 30, which starts from a point below the bottle exit mouth 12 and terminates inside the chamber of the bottle 11; in particular, said passage means 35 extends for the entire height of the tube 30 piece.

Figure 2:
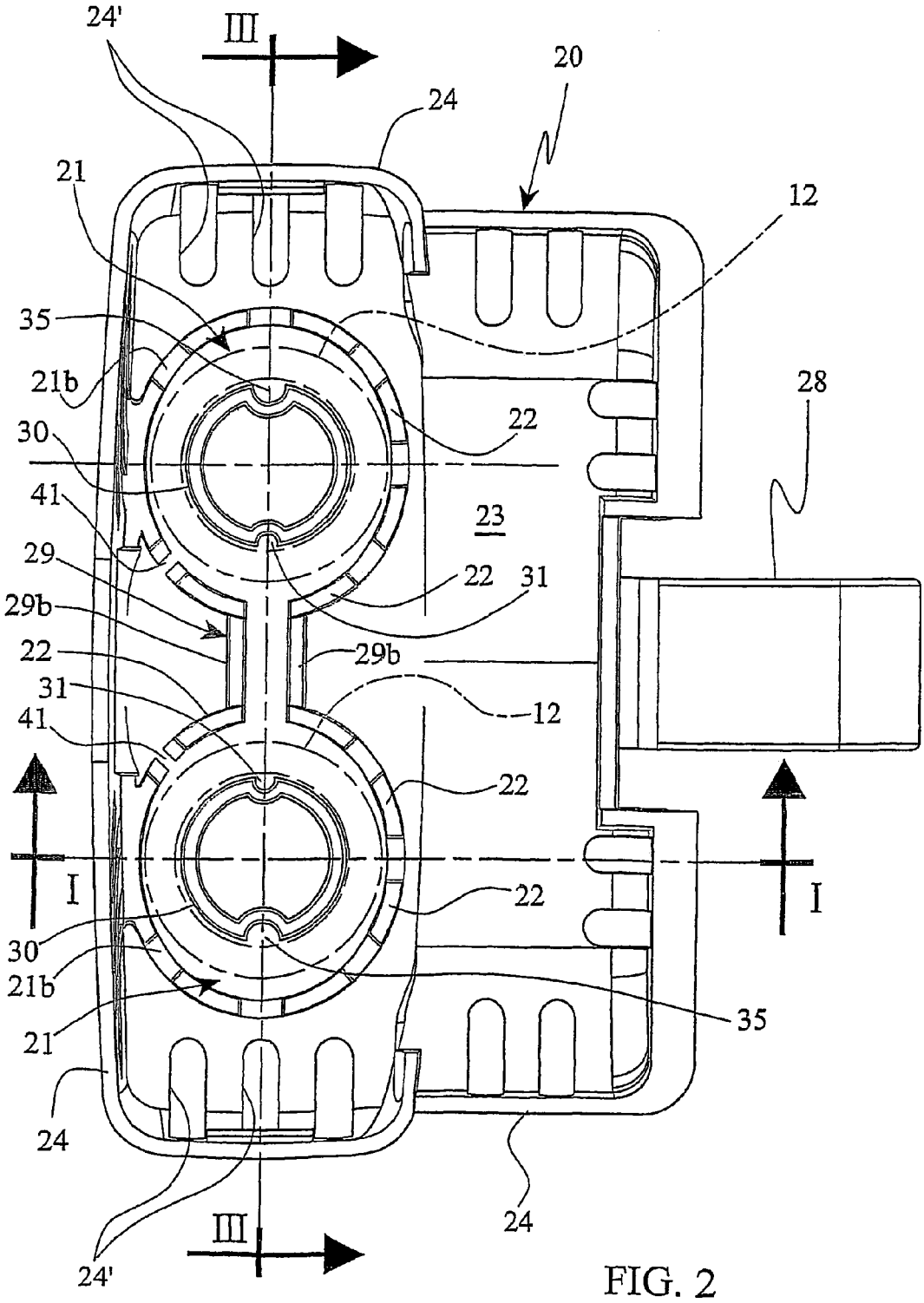
FIG. 2 is a plan view from above showing just the support means of FIG. 1.
Figure 3:
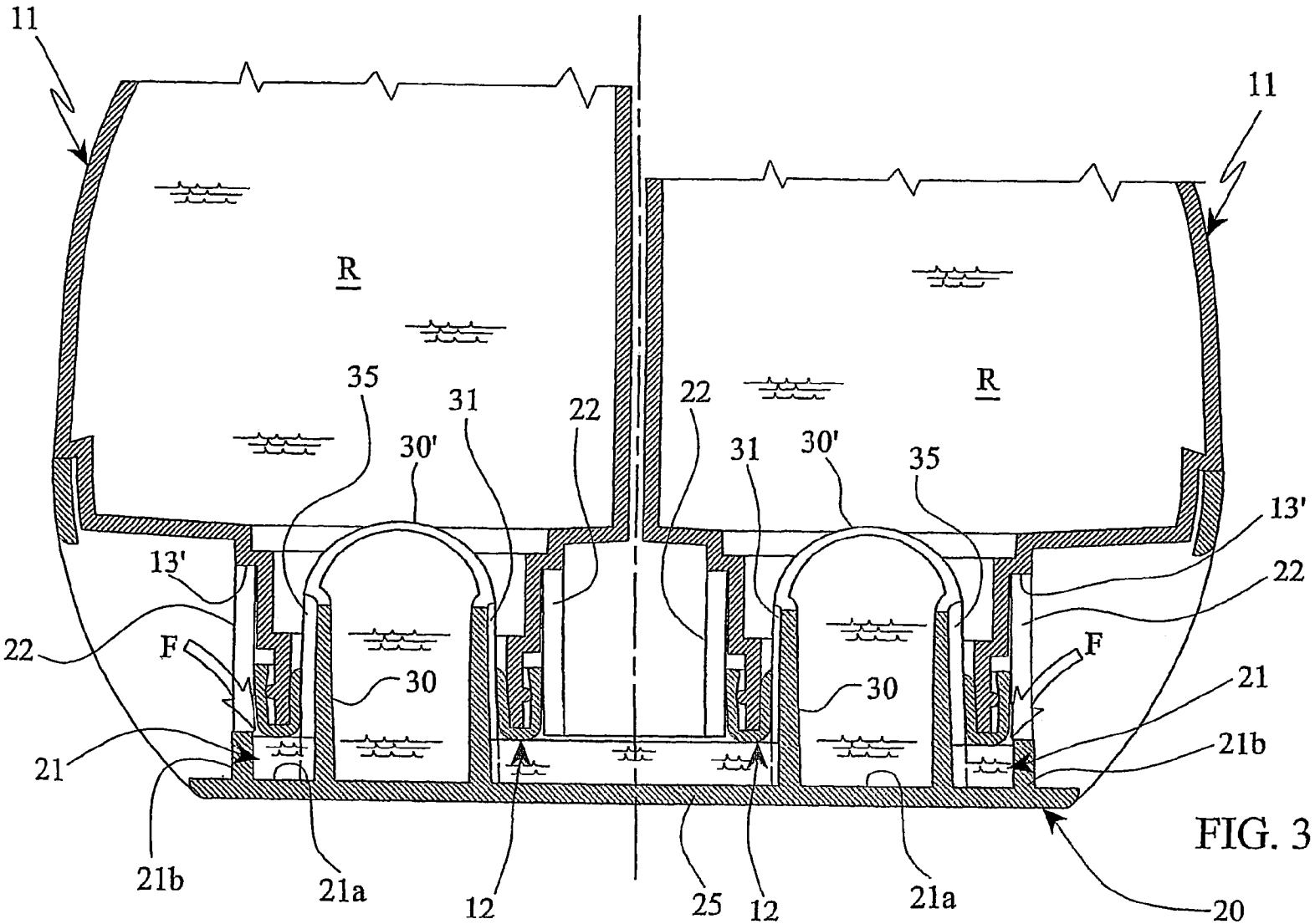
FIG. 3 is a section through the entire dispenser taken on the plane III—III of FIG. 2.

In addition, the passage means 31 is located in a geometrical position relatively far from the active substance passage means 35, in particular in a diametrically opposite, position (see FIGS. 2 and 3).

Each reservoir 21 is arranged to contain a determined maximum level of liquid (indicated by L1 in FIG. 3A), and to contain the exit mouth 12 of the bottle 11 with its lower end passage cross-section (indicated by P1) positioned below the maximum liquid level L1.

According to an important characteristic of the invention, the side walls 21*b* of the reservoirs are joined together by a common corridor 29, which connects them together. In particular, the corridor 29 is disposed on the axis which joins the centres of the two reservoirs 21 together and is bounded by two side walls 29*b* having the same height as the walls 21*b*; it has a width much smaller than the plan diameter of the reservoirs 21, for example from ⅕ to ⅙ thereof (in practice 2–5 mm).

In the illustrated embodiment, each reservoir 21 is defined by the substantially flat, horizontal collection surface, 21*a* and by the substantially vertical, cylindrical side wall 21*b*, which extends about the exit mouth 12 through an incomplete round angle, which meets the corridor 29.

The inner diameter of the side wall 21*b* is greater than the maximum outer diameter of the exit mouth 12, so that this can be contained within the side wall 21*b* a short distance therefrom.

The upper end edge of the side wall 21*b* determines the maximum level L1 of liquid which collects within the reservoir 21.

Figure 3A:
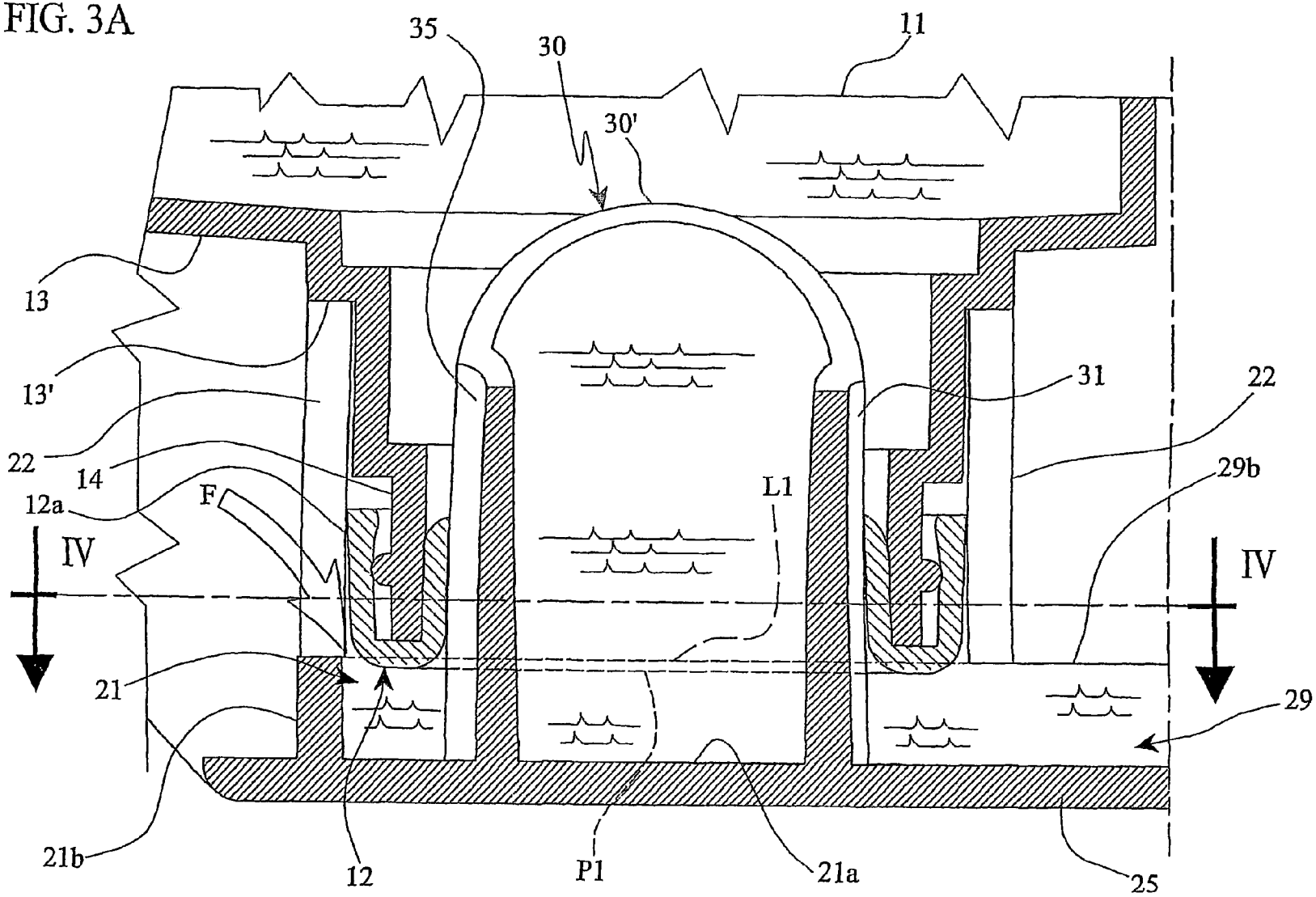
FIG. 3A is an enlarged detail of FIG. 3.
Figure 4:
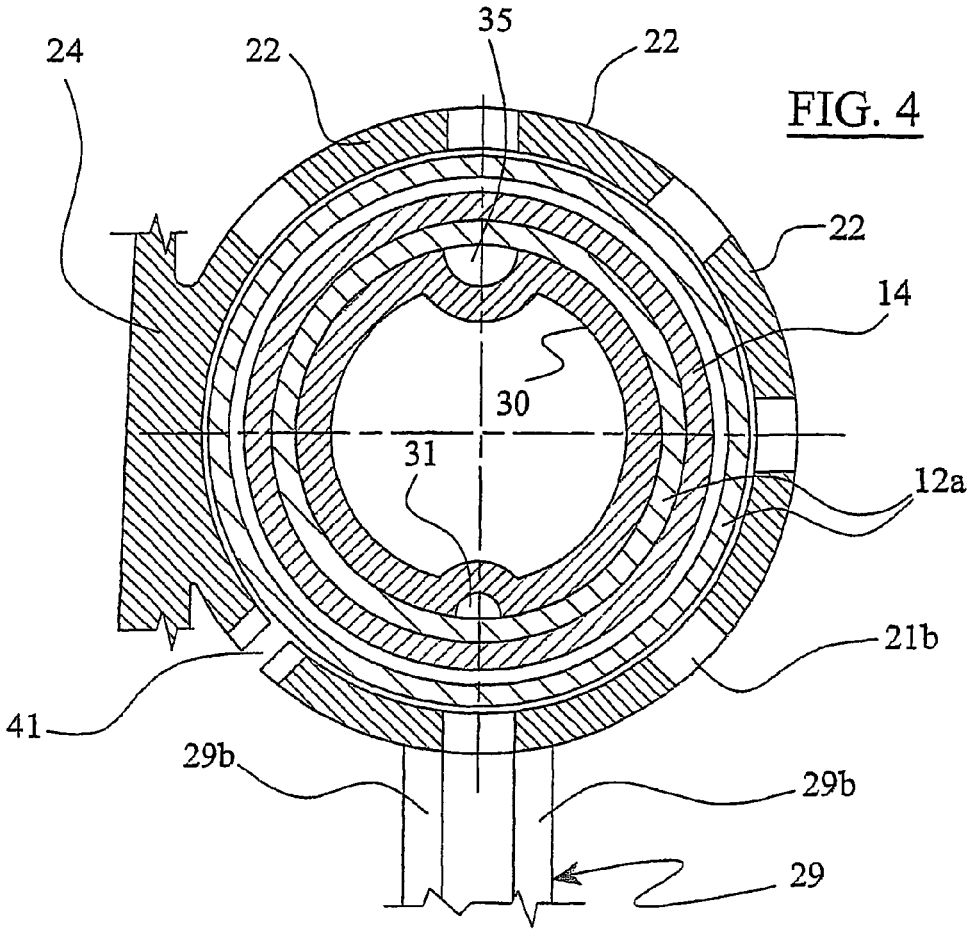
FIG. 4 is a section on the plane IV—IV of FIG. 3A.
Figure 5:
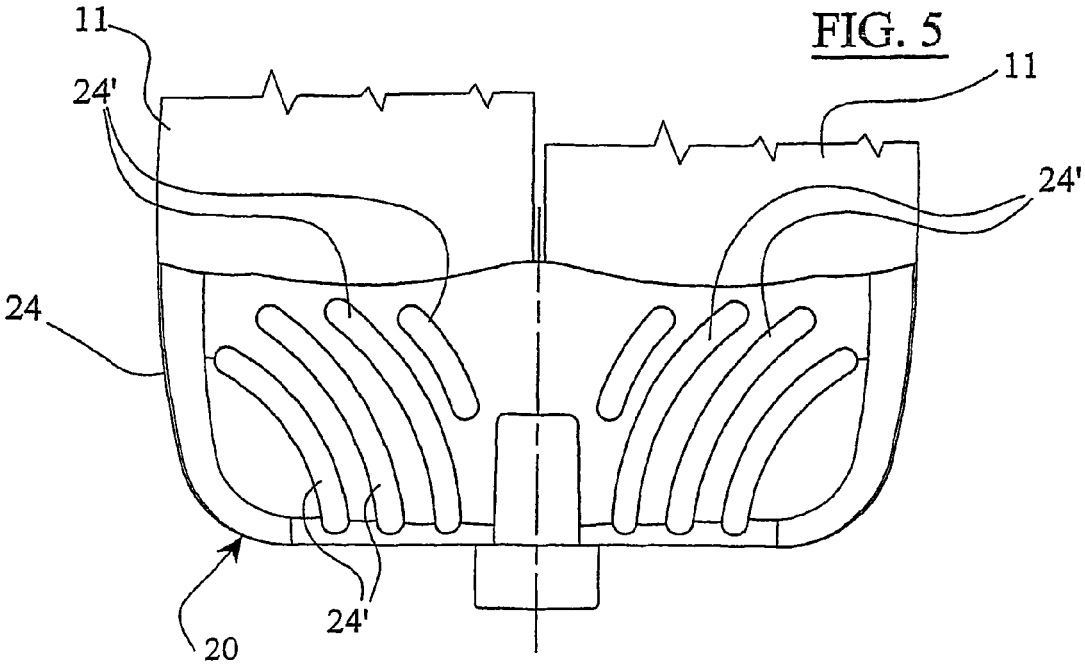
FIG. 5 is a front view of the lower part of the dispenser.

The side wall 21*b* possesses some upwardly projecting wall extensions 22 of crenellation form, which define a resting means for the body 13 of the bottle 11 in order to position the bottle mouth 12 in a predetermined and precise geometrical relationship with the reservoir 21. The bottle 11 possesses a shoulder 13', from which there projects a cylindrical neck 14 carrying the mouth 12 at its end. The crenellation formed by said extensions 22*b* surrounds the mouth 12 and neck 14 of the bottle 11 when in an inverted position, to supportingly receive the shoulder 13' with its upper end edge; when in this position the mouth 12 is inserted into the reservoir 21, with its lower exit section P1 lying at a level lower than the maximum level L1 (FIG. 3A).

In detail, the mouth 12 shown in the figures comprises an annular element 12*a* rigidly embracing the end of the neck 14, to which there is joined a circular disc 12*b* for hermetically closing the passage port for the active substance R.

The lower end surface of the element 12*a* defines the lower end passage section P1. This section P1 lies a small distance from the upper edge of the lateral wall 21*b* of the reservoir 21, so that a narrow passageway (indicated by F) remains defined for the flushing water towards the concavity of the reservoir 21.

Specifically, the tube piece 30 is cut in an inclined manner to form an upper point 30' which projects upwards by an extent such as to penetrate through the mouth 12 of the bottle when placed in its position of use. To dispose the bottles 11 in their position of use, they are inserted and pushed manually downwards to cause the respective tube piece 30 to penetrate into each of them so that its point detaches or tears the circular disc 12*b* from the annular element, to enable the active substance R present in the bottle 11 to descend through the exit mouth 12. The support means 20 together with the thus attached bottle 11 is then placed in the W.C. bowl such that the collection surface 21*a* lies substantially horizontal or nearly so, and the flushing water fed into the W.C. bowl strikes the region in which the reservoir 21 lies.

The liquid substance R of each bottle 11 descends through the (open) mouth 12 and fills the internal closed space of the tube piece 30; this substance leaves outwards only through the passage means 35, from which it descends into the respective reservoir 21 where it accumulates until it reaches or nearly reaches (but without exceeding it) the maximum level L1, at least in the region surrounding the lower mouth of the passage means 35, and also spills out into the corridor 29 to join the substance originating from the other bottle 11.

Using an active substance R having a viscosity of $1000–3000\times10^{-2}$ P (poise), it has been found that if a sufficiently small ventilation passage means 31 is provided, the active substance R does not emerge from the ventilation passage means 31.

At this point, as the mouth 12 is hermetically sealed, a vacuum environment forms in the upper part D of the internal chamber of the bottle 11 above the level of the active substance R, which in combination with the external atmospheric pressure and the weight of the substance contained in the bottle, reaches static equilibrium, without the substance R emerging from the bottle 11.

When a flush is activated, the flushing water penetrates into the reservoirs 21 through the gaps F and into the corridor 29, to carry away a small quantity of the substance R of each reservoir 21, to dilute it and release the deodorant/cleansing/refreshing/disinfectant action of the substances. It has been observed experimentally that when a part of the active substance is carried away, this, probably together with the turbulence produced by the flush, causes a little ventilation air to enter the bottle 11 through the passage means 31 and reach the upper part D. This changes the equilibrium between the pressure in the bottle interior and the external pressure in the reservoir 21, to cause a gauged descent of the level L2, corresponding to one measure of active substance R, with consequent restoration of the level L1 in the reservoir 21.

For this to happen, the geometrical characteristics of the ventilation passage means 31 are in relation to the physical-chemical characteristics of the active substance R (in particular to its viscosity) in order to achieve a gauged passage of air into the bottle 11, such that the active substance normally does not emerge from the bottle 11, at least to a relevant extent, whereas it leaves in a gauged manner from the bottle 11 when the flushing water flow strikes the containing reservoir 21.

Excellent results are obtained with a dispenser in which the cross-section of the ventilation passage means 31 has an area of 3–6 $mm^2$ when the active substance has a viscosity of $1600–2400\times10^{-2}$ P (poise).

Moreover, preferably, the distance of the lower section P1 from the collection surface 21*a* is relatively small, equal to a few millimetres, the distance between the maximum level L1 of the reservoir 21 and the lower section P1 of the mouth 12 being even less. It has been observed that these characteristics can also influence regular ventilation of the bottle 11 through the passage means 31.

Tests carried out with a dispenser without the common corridor 29, i.e. with the reservoirs 21 isolated from each other, showed a consumption difference for the two bottles 11, whereas with the dispenser of the invention, because of the presence of the common corridor 29, there is substantially equal consumption for the two bottles 11, which empty more or less simultaneously.

A possible explanation of this favourable result is that inevitably the flushing water strikes the two reservoirs 21 differently (for example because one is positioned in front of the other and hence it partly protects it from the flow), and hence without the corridor 29 it would remove different quantities of active substance from them; instead, the presence of the corridor acts as a balancing element (even if it is not completely clear how this happens).

To facilitate the washing-away and removal of the active substance R by the water flow, the support means 20 comprises a horizontal platform 23 which surrounds the collection surfaces 21*a* of the reservoirs 21 and is surrounded in its turn by a vertical wall 24 which defines a relatively wide basin, provided with numerous wide apertures 24' for passage of the water, which surrounds the containing reservoir 21 and the lower portion of the inverted bottle 11.

It has been observed that under certain circumstances a problem can arise, namely that at each flush of water, a little water remains inside the reservoir 21, and that as the number of flushes increases, the active substance R contained in the bottle 11 becomes increasingly diluted as the level L2 in the bottle falls, until its percentage is excessively low compared with the water. This drawback is obviously unacceptable as the positive action of the active substance gradually falls in intensity as the number of water flushes increases.

This problem is avoided by providing, in the containing reservoir 21, at least one drainage aperture 41 of gauged passage size such as to enable water to pass while preventing passage of the active substance.

Specifically, in the illustrated embodiment, a drainage aperture 41 in the form of a vertical slot is provided in the side wall 21*b* of the containing reservoir 21, preferably along its entire height, and having a width of 0.5–2.5 mm in the case of an active substance R of viscosity $1600–2400\times10^{-2}$ P (poise). Preferably the slot 41 is positioned a geometrically significant distance from the passage means 35 for the active substance, in particular close to the ventilation passage means 31.

In this case, it has been observed that after the flushing water has at least partly struck and washed away the contents of the reservoir 21, it drains through the slot 42 together with the more diluted active substance part, leaving inside the reservoir 21 only the more viscous active substance part.

Alternatively, one or more drainage apertures, for example in the form of through holes, can be provided in the collection surface 21*a* of the containing reservoir 21.

In certain cases, especially with an active substance having a relatively high viscosity and with a water drainage aperture located in a position relatively distant from the passage means 35 for the active substance, it has been observed that the active substance contained in the reservoir 21 falls in level starting from the maximum level point L1, located in correspondence with the passage means 35, until it becomes practically zero in correspondence with the aperture 41, with the result that the substance does not emerge from the aperture 41 even if this has a substantial width.

According to a different embodiment (illustrated in FIG. 6,) the ventilation passage means comprises a thin tubular ventilation conduit 32 positioned within the tube piece 30 to communicate with the air below the lower wall 25 of the containing reservoir 21 and projecting upwards towards and through the mouth 12 of the bottle 11. The tubular conduit 32 is fixed to the lower wall 25 to rise vertically from it, in a position in the interior of the tube piece 30, and presents at its top an upper end passage opening 32' for the air. With this type of dispenser excellent behaviour has been observed even if the water drainage aperture 41 is lacking. The geometrical characteristics of the ventilation passage means 31, in relation to the viscosity of the active substance R, are determined such that:

- the quantity of ventilation air entering the bottle 11 is sufficient, after each flush (or after a small number of flushes), to cause the upper level L2, by virtue of the pressure increase produced inside the bottle, to descend by an amount corresponding to the measure of substance R released into the water flow,
- while at the same time a vacuum level remains inside the bottle which is able to prevent the substance R from overflowing out of the reservoir 21.

Preferably, in the ventilation conduit 31, the lower end passage opening 32" of the conduit 32 is larger than the upper end passage opening 32'.

Excellent results have been obtained with dispensers in which:

- the lower end opening 32" has a diameter between 3.5 mm and 5 mm,
- the upper end opening 32' has a diameter between 0.3 mm and 1.5 mm, said conduit 32 projects upwards for a length of 5–15 mm, the active substance has a viscosity between 1600–2400× $10^{-2}$ P (poise).

It has been experimentally observed that after each water flush (or after a small number of flushes), a small number of air bubbles penetrate from the outside to the inside of the bottle 11 through the ventilation conduit 32, to influence its pressure and give rise, during operation, to regular emission of the active substance R at each water flush, with the active substance R contained inside the bottle 11 maintaining its active characteristics (deodorant/cleansing/refreshing/disinfectant and the like) substantially constant or nearly constant with time for a relatively large number of flushes (up to 250–450 flushes with 50–55 ml of active substance), and not mixing with the water other than to a relatively small extent at the end of its life.

As an alternative to the tubular conduit 32, said ventilation passage means can consist of a through aperture, in the form of a hole, provided in the lower wall 25 of the containing reservoir 21 in a position facing the bottle mouth (not shown in the figures). Excellent results have been obtained where said through aperture has a diameter between 1 mm and 2 mm for an active substance viscosity of 1600–2400×$10^{-2}$ P poise).

Figure 6:
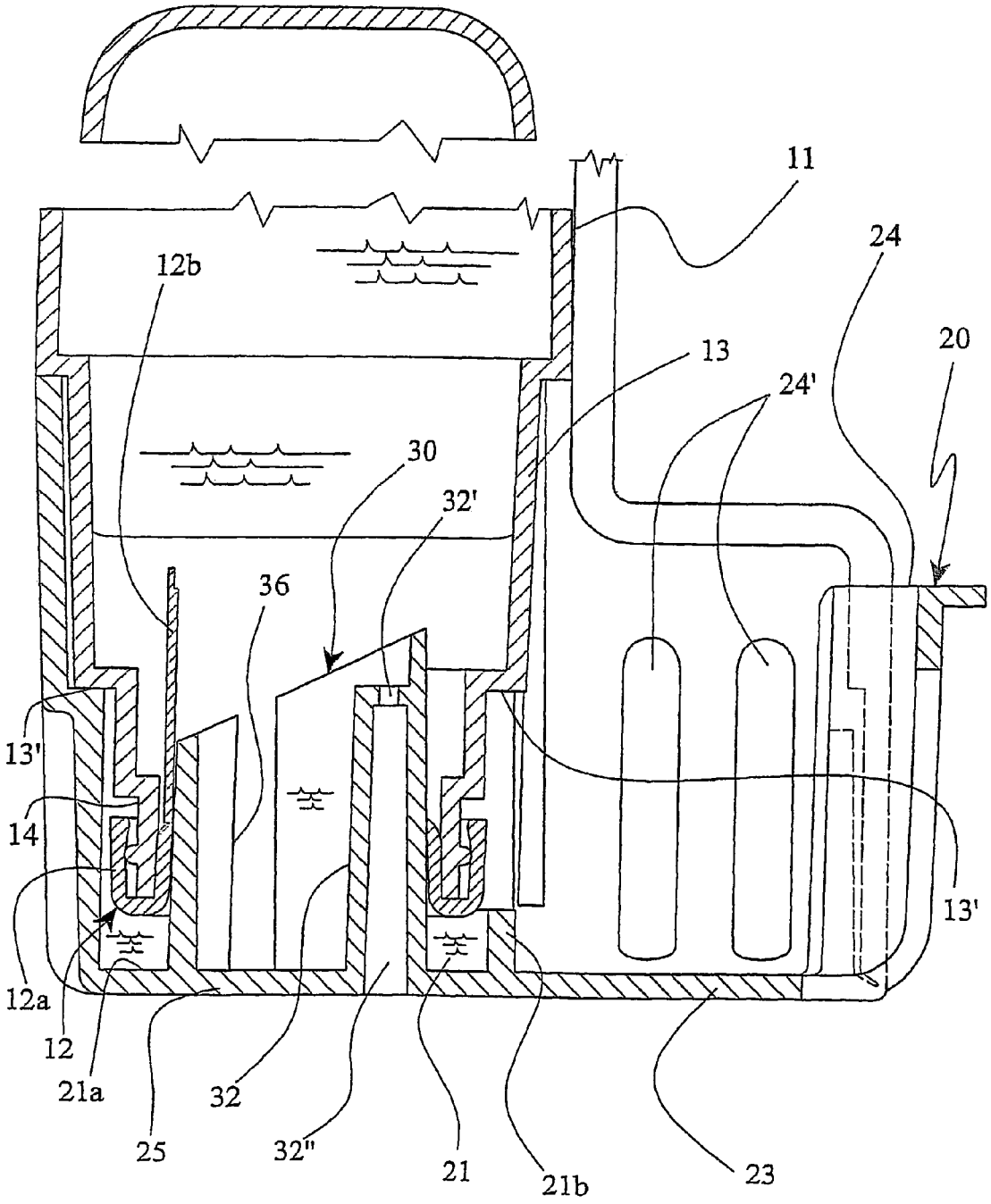
FIG. 6 is a section such as that of FIG. 1, through a second embodiment.

According to the embodiment shown in FIG. 6, the passageway for the active substance from the bottle 11 to the reservoir 21 is defined by a vertical through slot passing through the entire thickness of the wall of the tube piece 30 and starting from a point in the interior of the chamber of the bottle 11 to terminate below the exit mouth 12, this enabling the active substance R to flow to the outside from the interior of the tube piece 30. In particular, this slot can extend along the entire height of the side wall of the tube piece 30.

A draining passage means could also be dispensed with. In this case the aforestated problem of excessive dilution of the active substance is solved by providing the reservoir 21 with at least one discharge aperture, in the form of a through hole positioned in the lower wall 25 outside the tube piece 3, the passage opening of which is sized on the basis of the viscosity of the active substance R, to enable water top ass but to prevent passage of the active substance R. As an alternative to these discharge holes, or in combination therewith, said vertical slot 41 can be provided in the side wall 21*b* of the reservoir.

By virtue of the presence of these drainage holes/slot, the flushing water which tends to collect in the reservoir 21 is effectively drained off, so preventing or at least delaying the dilution of the active substance with time.

Numerous modifications of a practical-applicational nature can be made to the invention, for example the two bottles 11 can be joined together to form a single body, comprising however two separate compartments for two separate liquids.

The invention claimed is:

1. A multiple liquid active substance dispenser for a W.C. bowl, to be housed within the W.C. bowl, comprising at least two bottles (11) having separate internal chambers, each for containing an active substance (R) in the liquid state and having an exit mouth (12) for the active substance (R), and a support means (20) for supporting said bottles (11) in an inverted position, with their mouth (12) facing downwards, in a position subjected to the action of the flushing water flow, said bottles (11) being separate from the support means (20), characterised in that the support means (20 comprises:

for containing the active substance at least two reservoirs (21) located in a position subjected to the action of the flushing water flow and arranged to receive the mouth (12) of the bottle, a like number of closure members (30), each positioned in said containing reservoir (21) to each close the mouth (12) of the respective bottle (11);

for the active substance at least one passage means (35, 36) associated with each closure member (30) to enable the active substance to pass from the internal chamber of the bottle (11) to the containing reservoir (21), each containing reservoir (21) having a side wall (21*b*) defining a volume for containing a quantity of active substance which closes said passage means (35, 36) for the active substance, the side walls (21*b*) of the reservoirs being joined together by a common corridor (29) which connects them together.

2. A dispenser as claimed in claim 1, characterised in that said common corridor (29) is bounded by two side walls (29*b*) having the same height as the walls (21*b*), and has a width much smaller than the plan diameter of the reservoirs (21).

3. A dispenser as claimed in claim 1, characterised in that said containing reservoirs (21) have an upwardly facing concavity located in the zone subjected to the water flow, to contain a determined level of liquid, and to contain the exit mouth (12) of the respective bottle with its lower passage cross-section (P1) positioned below the maximum level (L1) of the liquid present in the reservoir (21).

4. A dispenser as claimed in claim 1, characterised by comprising, for each bottle, at least one ventilation passage means (31 and 32) which, when in use, connects the internal chamber of the bottle (11) to the atmospheric air.

5. A dispenser as claimed in claim 1, characterised in that the geometrical characteristics of the ventilation passage means (31, 32) are in relation to the physical-chemical characteristics of the active substance so as to achieve a gauged passage of air into the interior of the bottle (11) such that the active substance does not normally leave the bottle (11), at least not to a relevant extent, whereas it leaves the bottle (11) to a gauged extent when the flushing flow strikes the containing reservoir (21).

6. A dispenser as claimed in claim 3, characterised in that said closure member (30) is in the form of an upwardly facing tube piece closed lowerly, and having an upper end which projects upwards beyond the exit mouth (12) of the bottle associated with the support means (20), the exit mouth (12) being in such geometrical relationship with said member (30) as to sealedly embraces its lateral surface.

7. A dispenser as claimed in claim 1, characterised in that said containing reservoir (21) comprises at least one drainage aperture (41) having a passage opening sized such as to enable water to pass but to prevent passage of the active substance.

* * * * *